US009612078B2

(12) United States Patent
EuDaly

(10) Patent No.: US 9,612,078 B2
(45) Date of Patent: Apr. 4, 2017

(54) RUBBER BAND GUN, METHOD OF USE, AND METHOD OF ASSEMBLY

(71) Applicant: Brent A. EuDaly, Centerville, KS (US)

(72) Inventor: Brent A. EuDaly, Centerville, KS (US)

( * ) Notice: Subject to any disclaimer, the term of this patent is extended or adjusted under 35 U.S.C. 154(b) by 0 days.

(21) Appl. No.: 15/180,846

(22) Filed: Jun. 13, 2016

(65) Prior Publication Data

US 2016/0363411 A1 Dec. 15, 2016

Related U.S. Application Data

(60) Provisional application No. 62/174,908, filed on Jun. 12, 2015, provisional application No. 62/174,888, filed on Jun. 12, 2015.

(51) Int. Cl.

| | |
|---|---|
| ***F41B 7/08*** | (2006.01) |
| ***F41B 7/02*** | (2006.01) |
| ***F41B 7/00*** | (2006.01) |
| ***A63H 5/04*** | (2006.01) |

(52) U.S. Cl.

CPC ..... *F41B 7/025* (2013.01); *A63H 5/04* (2013.01); *F41B 7/003* (2013.01)

(58) Field of Classification Search

CPC ..... F41B 7/025; A63H 5/04

USPC ..... 124/17, 18, 19, 35.1; 446/473

See application file for complete search history.

(56) References Cited

U.S. PATENT DOCUMENTS

| | | | | | |
|---|---|---|---|---|---|
| 1,234,163 | A | * | 7/1917 | Henderson | F41B 3/02 124/17 |
| 1,723,554 | A | | 8/1929 | Malott | |
| 1,724,708 | A | * | 8/1929 | Harris | F41B 7/025 124/19 |
| 1,759,084 | A | * | 5/1930 | Baum | F41B 7/025 124/19 |
| 1,821,381 | A | | 9/1931 | Gerken | |
| 1,883,826 | A | | 10/1932 | Schmidt | |
| 1,909,927 | A | * | 5/1933 | Beauchamp | F41B 7/025 124/19 |
| 1,921,017 | A | | 8/1933 | Weber | |
| 2,008,595 | A | * | 7/1935 | Reed | F41B 7/025 124/19 |
| 2,289,490 | A | * | 7/1942 | Fisher | F41B 7/025 124/19 |
| 2,462,723 | A | * | 2/1949 | Crnich | F41B 7/025 124/19 |
| 2,529,047 | A | * | 11/1950 | Paul | F41B 7/025 124/19 |
| 2,550,873 | A | * | 5/1951 | Siders | F41B 7/025 124/19 |
| 2,578,198 | A | * | 12/1951 | Muggli | F41B 7/025 124/19 |
| 2,689,558 | A | * | 9/1954 | Sealer | F41B 7/025 124/19 |

(Continued)

*Primary Examiner* — Alexander Niconovich

(74) *Attorney, Agent, or Firm* — Law Office of Mark Brown, LLC; Christopher M. DeBacker

(57) ABSTRACT

An elastic rubber band launching toy gun that uses a new method to launches six elastic bands in rapid succession using a simple assembly of only six individual parts, and featuring an moving exterior slide in order to mimic the action on a real hand gun. The embodiments of this invention do not rely on any mechanism to return the trigger element to a firing position other than the elastic projectiles fired from the device.

4 Claims, 6 Drawing Sheets

(56) References Cited

U.S. PATENT DOCUMENTS 2,697,425 A * 12/1954 McElveen ..... F41B 7/025 124/19
2,741,238 A 4/1956 Arnold
2,793,635 A 5/1957 Koeller
2,917,037 A * 12/1959 Henderson ..... F41B 7/025 124/19
3,437,084 A * 4/1969 Hyter ..... F41B 7/025 124/19
3,468,296 A * 9/1969 Duval ..... F41B 7/025 124/19
3,494,345 A * 2/1970 Griffiths ..... F41B 7/025 124/19
3,515,387 A * 6/1970 House ..... F41B 7/025 124/19
3,812,833 A * 5/1974 Skillern ..... F41B 7/025 124/19
3,919,996 A * 11/1975 McAlister ..... F41B 7/025 124/19
4,033,313 A * 7/1977 Ryan ..... F41B 7/025 124/17
4,165,729 A * 8/1979 Niemirow ..... F41B 7/00 124/17
4,308,850 A * 1/1982 Hunter ..... F41B 7/025 124/19
4,379,445 A * 4/1983 LoBiondo ..... F41B 7/025 124/19
4,676,219 A * 6/1987 Miller ..... F41B 7/025 124/19
4,800,864 A * 1/1989 Small ..... F41B 7/025 124/19
4,949,494 A * 8/1990 Mims ..... F41B 7/025 124/19
5,170,770 A * 12/1992 Vosloh ..... F41B 7/025 124/19
5,205,266 A * 4/1993 Kilby, Jr. ..... F41B 7/025 124/19
5,222,472 A * 6/1993 Landingham ..... F41B 7/025 124/19
5,460,150 A * 10/1995 Joppe ..... F41B 7/025 124/19
5,595,165 A * 1/1997 Conte ..... A63H 5/04 124/18
5,692,489 A * 12/1997 Swanson ..... F41B 7/02 124/19
7,690,371 B2 * 4/2010 Slaven ..... F41B 3/005 124/18
9,140,517 B2 * 9/2015 Coulston ..... F41B 7/025
2008/0029104 A1 2/2008 Vanderpool
2009/0314272 A1 * 12/2009 Lin ..... F41A 9/74 124/48

* cited by examiner

RUBBER BAND GUN, METHOD OF USE, AND METHOD OF ASSEMBLY

CROSS-REFERENCE TO RELATED APPLICATIONS

This application claims priority in U.S. Provisional Patent Application No. 62/174,908, filed Jun. 12, 2015 and 62/174,888, filed Jun. 12, 2015, both of which are incorporated herein by reference.

BACKGROUND OF THE INVENTION

1. Field of the Invention

The present invention relates generally to a rubber band gun and method for use and assembly thereof, and more specifically to rubber band launching toy gun that fires six rubber bands in rapid succession, releasing only one rubber band with each trigger pull.

2. Description of the Related Art

Elastic rubber band launching toy guns exist in many forms, ranging from very simple single shot models to extremely complex models capable of launching hundreds of elastic bands in a matter of seconds.

Traditional rubber band guns use a variety of mechanisms to hold a band in a stretched position and for releasing that band, resulting in the band being "fired" from the gun toward a target. The simplest such release mechanism uses a simple clothespin which can clasp down on the band and causes the band to be released upon depressing the pin. This results in a simple, yet limited single-fire pistol.

The most common style of elastic band launching gun uses a plastic, multi-toothed rotating wheel to release rubber bands in a controlled manor one at a time. Another type of elastic band launching gun uses a "step-up" action to move a collection of individual elastic bands up a series of notches, releasing one elastic band off of the topmost notch with each advancement of the action More complicated rubber band guns include repeater pistols which rely upon a tooth wheel which spins as the trigger is depressed. These pistols allow for a rapid succession of shots, but each shot will only fire the band or bands as they are loaded onto the wheel. There is no way to load up additional bands for firing using the wheel mechanism alone.

Heretofore there has not been available a system or method for a rubber band gun with the advantages and features of the present invention.

BRIEF SUMMARY OF THE INVENTION

The present invention relates generally to an elastic rubber band launching toy gun that uses a new method to launches six elastic bands in rapid succession using a simple assembly of only six individual parts, and featuring a moving exterior slide in order to mimic the action on a real hand gun.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Model 1911 Rubber Band Gun 2

Figure 1:
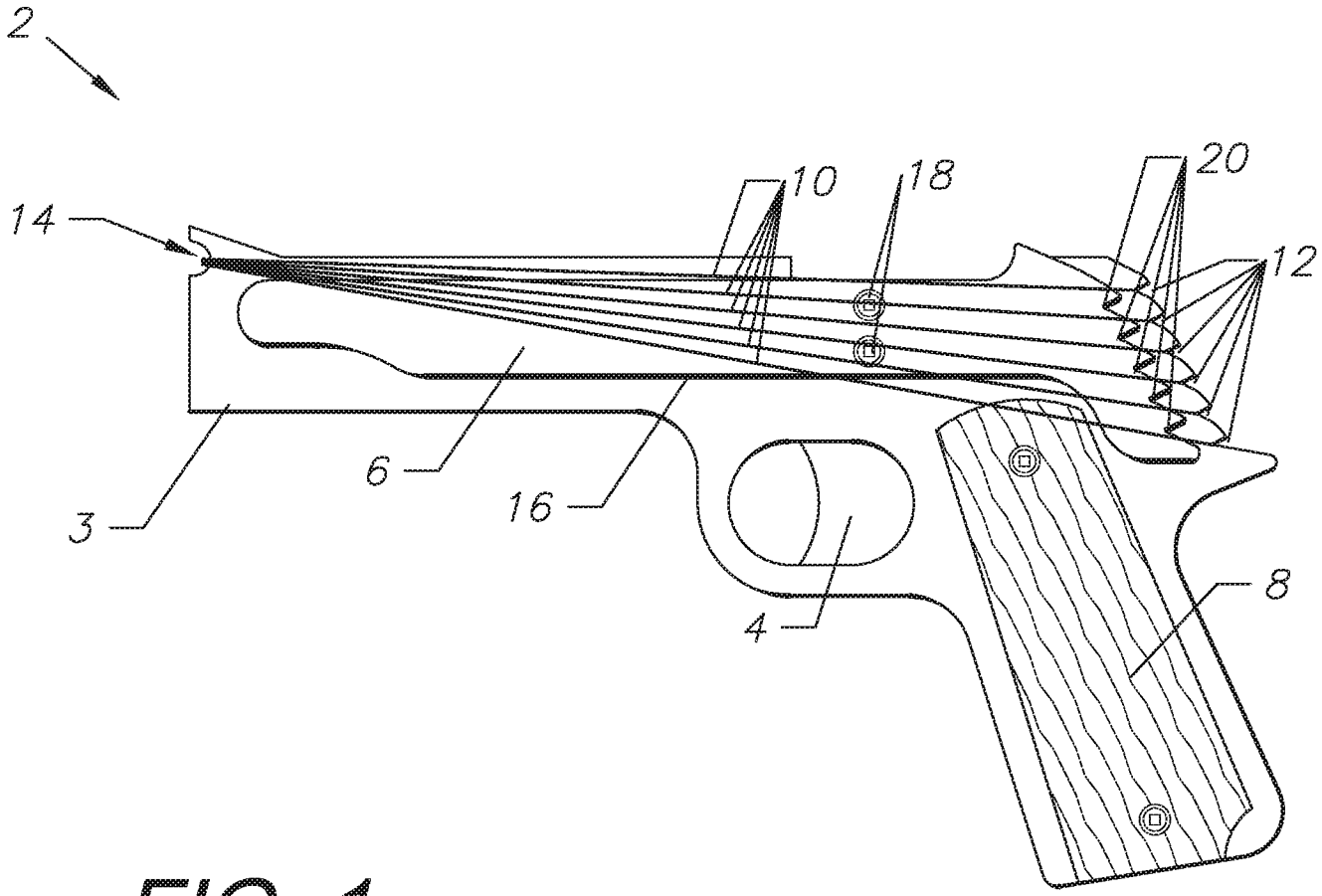
FIG. 1 is a side elevational view of a preferred embodiment of the present invention in the form of a replica M1911 pistol.
Figure 2:
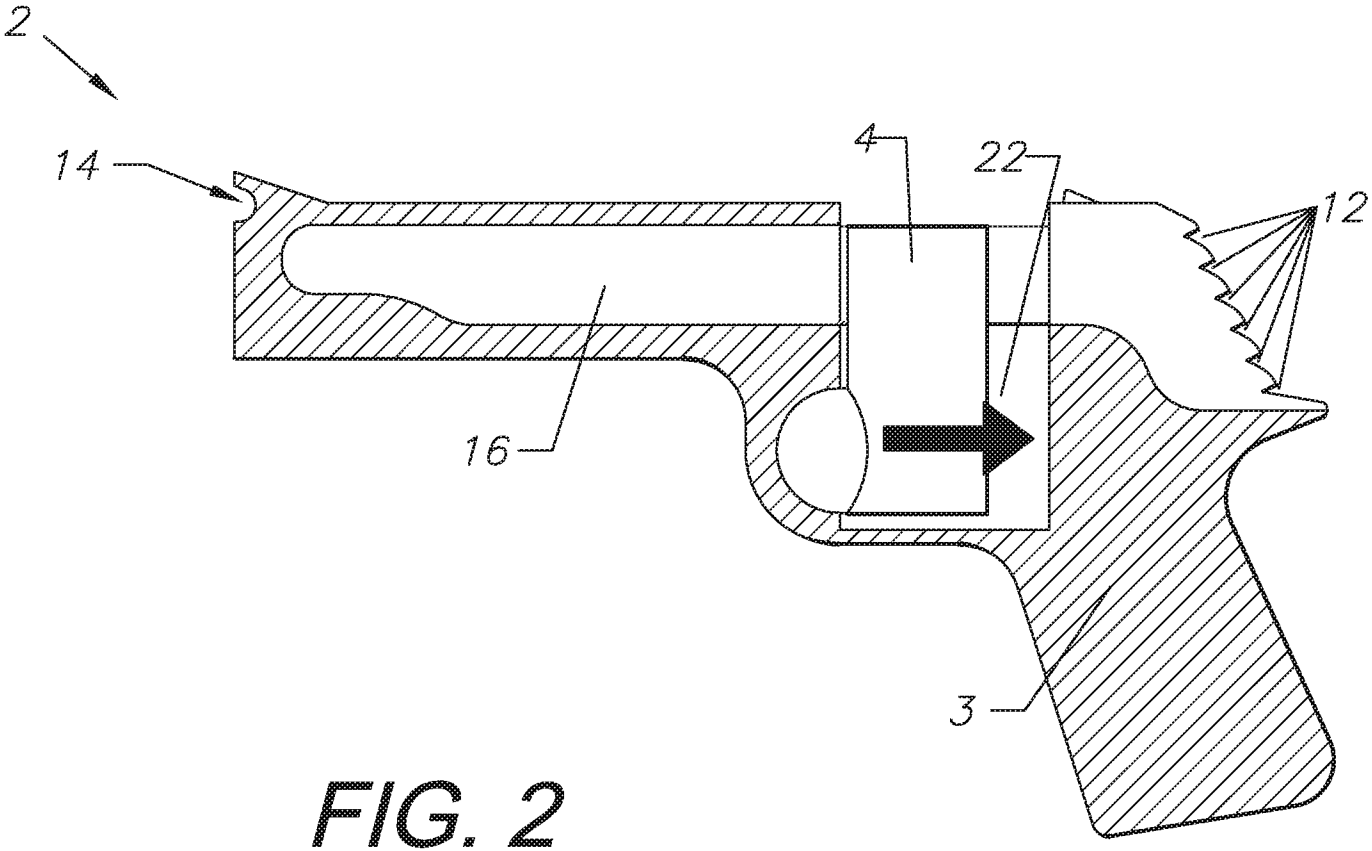
FIG. 2 is a sectional view thereof, taken about the line of FIG. 3.
Figure 3:
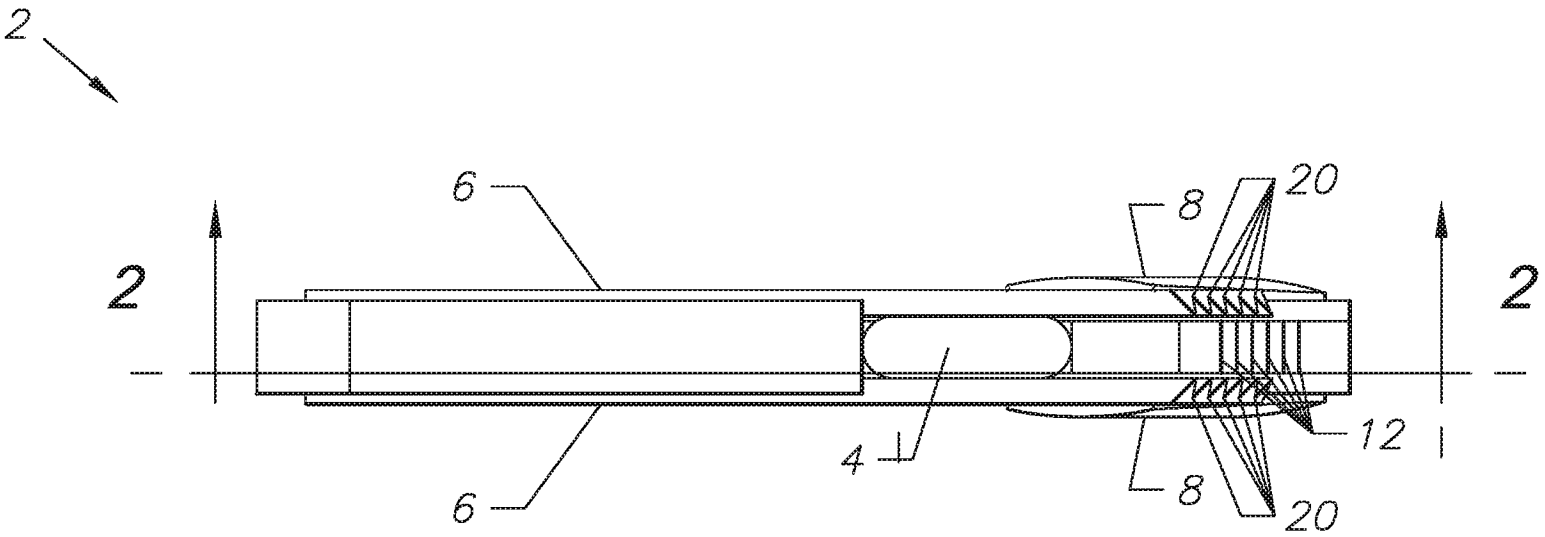
FIG. 3 is a top plan view thereof.
Figure 4:
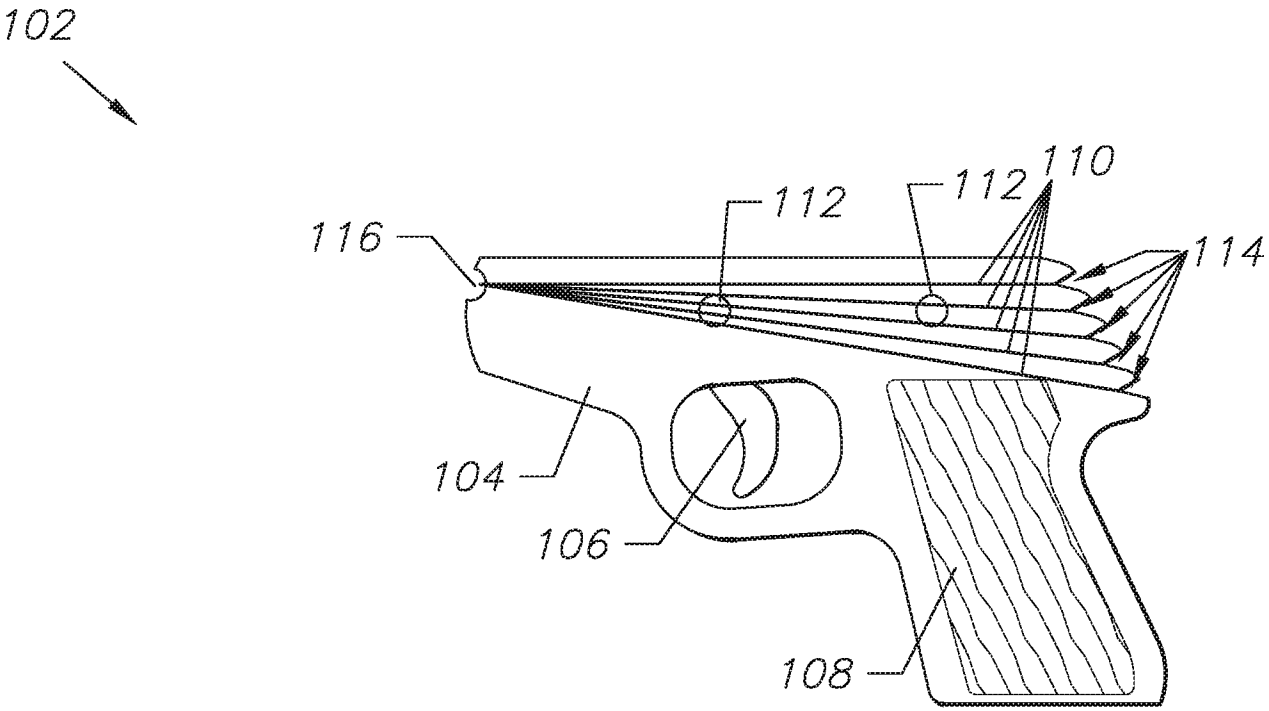
FIG. 4 is a side elevational view of an alternative embodiment of the present invention in the form of a replica PPK pistol.

As shown in FIGS. 1-3, a preferred embodiment of the present invention rubber band gun 2 is formed in the shape of a model 1911 pistol. This embodiment is constructed from seven parts. A main gun frame 3 which includes the handle, a trigger 4, a pair of exterior slides 6, a pair of wooden handle grips 8, and several elastic rubber band projectiles 10.

The elastic bands 10 are stretched from the front notch 14 to the rear notches 12 of the main gun frame 3. The slide 6 and trigger 4 are fastened together with screws 18. The trigger/slide assembly moves horizontally within the constraints of the slide recess 16 which is machined into the main gun frame 3 and within the constraints of the trigger recess 22 as best seen in FIG. 2. The slide 6 has a series of rear notches 20 that are slightly offset from the series of rear notches 12, on the main gun frame.

When the trigger 4 is pulled in a rearward direction as indicated in FIG. 2, the whole trigger 4 and slide 6 assembly moves rearward and stretches the elastic rubber band projectiles 10, disengaging them all at the same time from the rear notches 12 of the main gun 3 frame while subsequently engaging them in the rear notches 20 of the slide 6. The result is that the top most elastic rubber band projectile is released from the rubber band gun 2 and launched forward away from the operator. The remaining elastic rubber band projectiles 10 move forward and upward as the operator releases pressure off of the trigger, thus forcing the trigger 4 and slide 6 assembly forward and advancing the remaining elastic rubber band projectiles to the next most upward notch. This process automatically resets the trigger 4 and slide 6 assembly to its original forward position and the "firing" process is repeated each time the operator pulls the trigger 4 until all the elastic rubber band projectiles 10 have been released.

This embodiment is shaped to resemble a M1911 pistol as manufactured by Colt Manufacturing Company of Hartford, Conn. The firing and resetting process from a first, loaded position to a second, fired position back to the first, loaded position is done without the need for a separate band, spring, or other trigger element specifically for pulling the trigger back to a starting, non-firing position.

III. Alternative Embodiment Model PPK Rubber Band Gun 102

FIGS. 3-6 show an alternative embodiment rubber band gun 102 in the form of a PPK pistol. This embodiment is formed from five parts. A main gun frame 104, a trigger/slide 106, a pair of wood veneer handle grips 8, elastic rubber band projectiles 110, and a pair of dowels 112.

Figure 5:
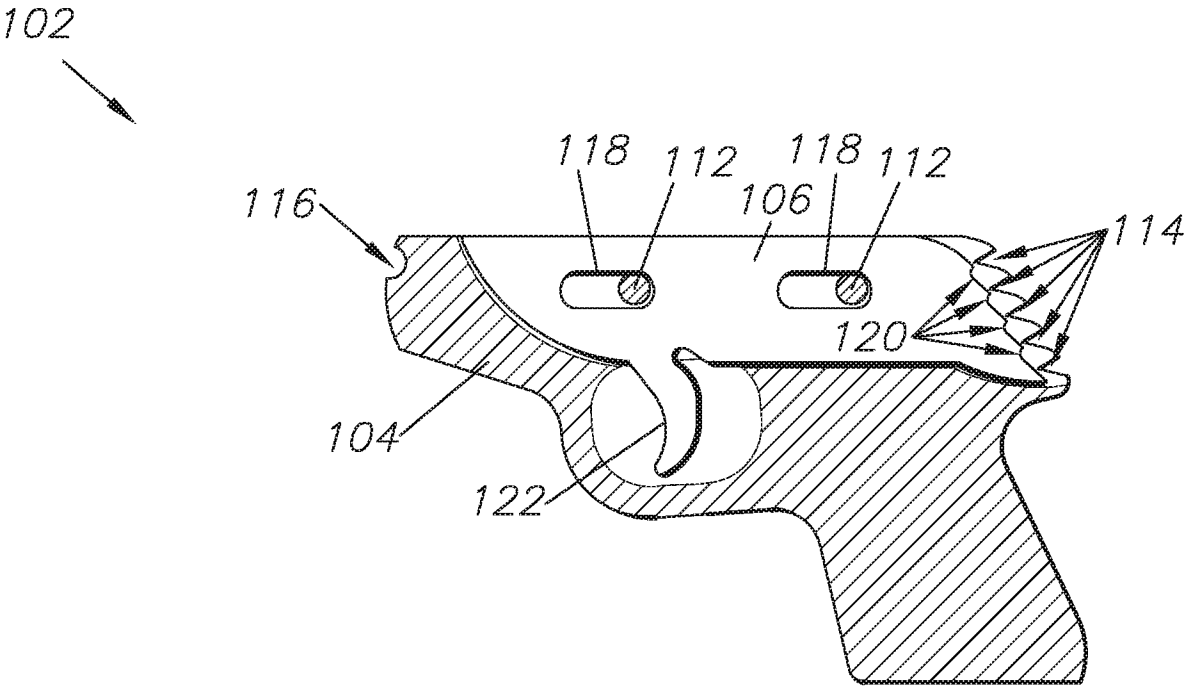
FIG. 5 is a sectional view thereof, taken about the line of FIG. 6.
Figure 6:
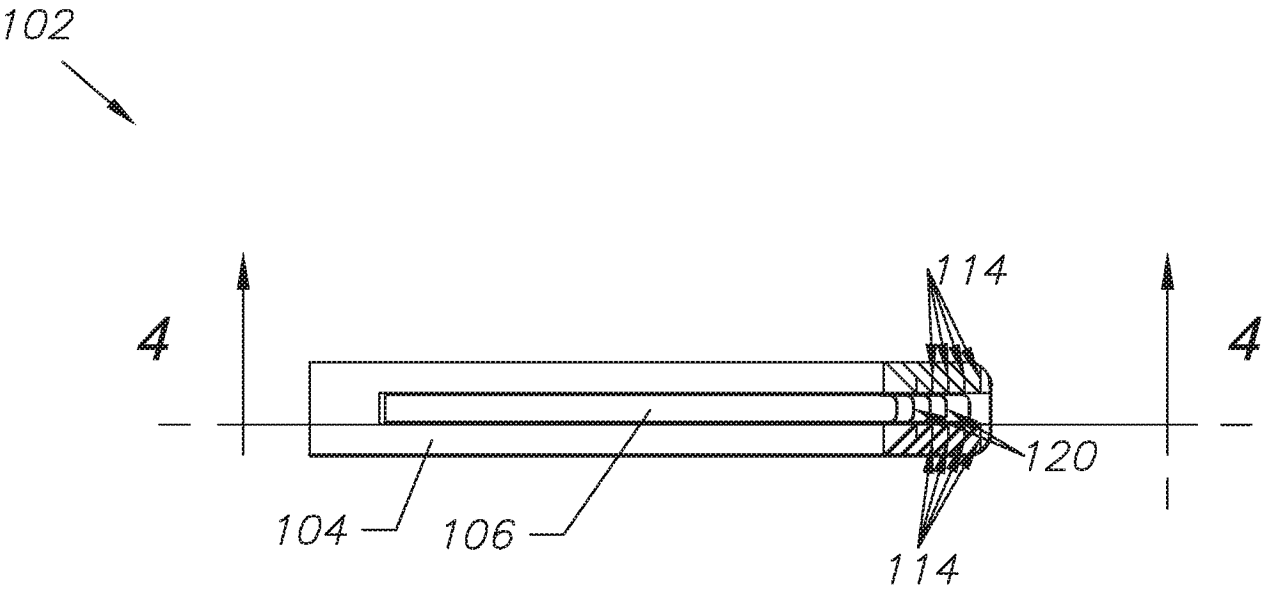
FIG. 6 is a top plan view thereof.

The elastic bands 110 are stretched from the front notch 116 to the rear notches 114 with one elastic band being held in each of the rear notches 114. The trigger/slide 106 as best seen in FIG. 5 moves horizontally within the constraints of the dowel notches 118, and the dowels 112, which are secured firmly within holes in the main gun frame 104. The trigger/slide 106 has a series of rear notches 120 that are slightly offset from the series of rear notches 114, on the main gun frame. When the trigger 122 is pulled in a rearward direction, the whole trigger/slide 106 moves with it and stretches the elastic rubber band projectiles disengaging them all at the same time from the rear notches 114 in the main gun frame while subsequently engaging them in the rear notches 120 of the trigger/slide 106.

The result is that the top most elastic rubber band projectile is released from the Model PPK Rubber Band Gun and launched forward away from the operator. The remaining elastic rubber band projectiles 110 move forward and upward as the operator releases pressure off of the trigger, thus forcing the trigger/slide 106 forward and advancing the remaining elastic rubber band projectiles to the next most upward notch without the need for an additional band or spring specifically for pulling the trigger forward. This process automatically resets the trigger/slide 106 to its original forward position and the "firing" process is repeated each time the operator pulls the trigger 122 until all the elastic rubber band projectiles 110 have been released.

This embodiment is shaped to resemble a Walther PPK pistol as manufactured by Carl Walther GmbH Sportwaffen of Ullm and Arnsberg, Germany. The firing and resetting process from a first, loaded position to a second, fired position back to the first, loaded position is done without the need for a separate band, spring, or other trigger element specifically for pulling the trigger back to a starting, non-firing position.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A toy gun comprising:

a gun frame including a handle and a trigger space;

a trigger affixed to a pair of slides, said slides being exterior to said gun frame;

said trigger and slides at least partially contained within a slide recess within said gun frame, such that said trigger and slides are allowed to move horizontally forward and rearward only;

a rear end of said gun frame including a plurality of static notches, a corresponding single front notch located at a front end of said gun frame;

a plurality of elastic projectiles configured to be stretched between said front notch and said rear notches, wherein each respective rear notch receives a single elastic projectile;

each rear end of said pair of slides containing a plurality of slide notches;

a pair of wood veneer handle grips, each affixed to an exterior face of said gun frame;

wherein said pair of slides and said trigger are configured to be slid from a first, loaded position to a second, firing position whereby said trigger forces said slides in a rearward direction;

wherein said plurality of slide notches are configured to eject a top-most of said plurality of elastic projectiles in a forward velocity away from said front notch and to advance all remaining of said plurality of elastic projectiles amongst said plurality of static notches; and wherein said trigger member is reset to said loaded position by said plurality of elastic projectiles only, and no other element is used to reset said trigger member to said loaded position, and all elastic projectiles are capable of being fired.

2. The toy gun of claim 1, wherein said gun is modeled after a M1911 pistol.

3. A toy gun comprising:

a gun frame including a handle and a trigger space;

a trigger slide assembly including a trigger portion, said trigger slide assembly placed within said gun frame such that said trigger slide assembly can travel horizontally within said gun frame, said trigger slide assembly including a pair of dowel notches;

a pair of dowels inserted through said gun frame and through said dowel notches of said slide;

a plurality of elastic projectiles configured to be stretched between a front notch and a plurality of rear notches, wherein each respective rear notch receives a single elastic projectile;

said slide containing a plurality of slide notches;

a pair of wood veneer handle grips, each affixed to an exterior face of said gun frame;

wherein said trigger slide assembly is configured to be slid from a first, loaded position to a second, firing position whereby said trigger forces said trigger slide assembly in a rearward direction;

wherein said plurality of slide notches are configured to eject a top-most of said plurality of elastic projectiles in a forward velocity away from said front notch and to advance all remaining of said plurality of elastic projectiles amongst said plurality of static notches; and wherein said trigger member is reset to said loaded position by said plurality of elastic projectiles only, and no other element is used to reset said trigger member to said loaded position, and all elastic projectiles are capable of being fired.

4. The toy gun of claim 3, wherein said gun is modeled after a Walther PPK pistol.

* * * * *